US006393733B1

(12) United States Patent
London et al.

(10) Patent No.: US 6,393,733 B1
(45) Date of Patent: May 28, 2002

(54) SHOE WITH ARCH SUPPORT

(76) Inventors: Eliyahu London, 24 Hazav Street, Mevaseret Zion 90805; Shmuel Brody, 16 Hazon-Ish Street, Apartment 6, Ramat Shlomo 97446, both of (IL)

( * ) Notice: Subject to any disclaimer, the term of this patent is extended or adjusted under 35 U.S.C. 154(b) by 0 days.

(21) Appl. No.: 09/601,610

(22) PCT Filed: Jan. 28, 1999

(86) PCT No.: PCT/IL99/00052

§ 371 (c)(1),
(2), (4) Date: Oct. 26, 2000

(87) PCT Pub. No.: WO99/39599

PCT Pub. Date: Aug. 12, 1999

(30) Foreign Application Priority Data

Feb. 5, 1998 (IL) ..... 123199

(51) Int. Cl.[7] ..... A43B 7/22

(52) U.S. Cl. ..... 36/91; 36/155; 36/160; 36/170

(58) Field of Search ..... 36/91, 155, 160, 36/170

(56) References Cited

U.S. PATENT DOCUMENTS 1,649,173 A * 11/1927 McDonough
2,068,251 A * 1/1937 Ullrich
2,082,891 A * 6/1937 Hubbard
2,182,843 A * 12/1939 Flynn et al.
2,191,210 A * 2/1940 Johnson
2,389,148 A * 11/1945 Grebow
2,933,834 A * 4/1960 Bourland
4,794,706 A * 1/1989 Puckhaber et al.
4,860,464 A * 8/1989 Misevich et al.
4,926,569 A * 5/1990 Bunch

* cited by examiner

*Primary Examiner*—Ted Kavanaugh
(74) *Attorney, Agent, or Firm*—Sughrue Mion, PLLC

(57) ABSTRACT

A shoe having a fixed insole and an upper being provided with an adjustable arch strap. The strap has an elastically stretchable portion interposed between a main portion and a free end portion of the strap. The strap further includes an indicator for rendering said tension reproducible.

4 Claims, 2 Drawing Sheets

SHOE WITH ARCH SUPPORT

This application is a continuation in parts of PCT/IL99/0052 filed Jan. 28, 1999.

TECHNICAL FIELD

The present invention relates to a shoe including an adjustable arch support.

BACKGROUND ART

Flatfoot, the cause of which is not well understood, essentially consists of the depression or collapse of the arch of the foot, produced by a disproportion between the weight to be borne and the muscles to bear it. This condition not only affects a person's gait, but may also produce internal rotation of the tibia, knee and femur during walking. It also reduces pelvic tilt, which is liable to lead to spinal scoliosis.

Treatment of flatfoot aims at restoring the arch to its proper shape and maintaining that shape during activity. Apart from very severe cases where surgical intervention might be indicated, the above aim is achieved by use of arch supports, of which there exist any number of designs.

A serious disadvantage of the known arch supports (the better ones of which cannot be bought off the shelves, but must be individually fitted) resides in the fact that, once fitted, their shape, i.e., the degree of their support, is permanent and unalterable, while the demands on the arch during a leisurely walk differ from those prevailing during strenuous sports activities. While a normal arch can cope with these differences, the collapsed or weak arch is either over-corrected for moderate activities or under-corrected for strenuous ones.

DISCLOSURE OF THE INVENTION

It is thus one of the objects of the present invention to provide an arch support that can not only be adjusted for a specific activity, but also provides reproducibility for such an adjustment if it is found to give favorable results.

According to the invention, the above objective is achieved by providing a shoe having a fixed insole and an upper, and being provided with an adjustable arch support comprising an arch support strap substantially of the width of the wearer's instep and fixedly attached at one of its ends to, or integral with, said insole at a point substantially below said instep and in the vicinity of the median line of said insole, said strap extending towards the right in a left shoe and towards the left in a right shoe, and having a main portion and a free end portion; eyelet means provided on the lip of the left lacing flap of said upper in the left shoe and on the lip of the right lacing flap of said upper in the right shoe, wherein, with the wearer's foot inside the shoe and resting on a first portion of said strap, said strap is passed from below through said eyelet means and pulled tight, until the wearer's arch has been raised to a desired position, after which said strap is doubled back upon itself and attached to the lateral outside surface of said upper with the aid of attachment means, characterized in that said strap comprises means responsive to the tension applied to said strap and that it includes indicating means for rendering said tension reproducible.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION

Figure 1:
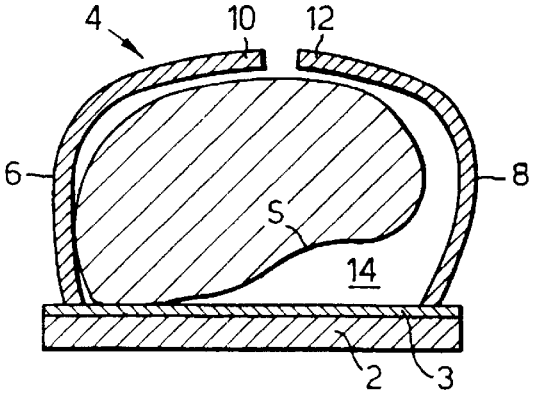
FIG. 1 is a schematic cross-section of the instep portion of a normal foot in a shoe.

Referring now to the drawings, there is seen in FIG. 1 a schematic cross-section of the instep of a normal foot inside a shoe having a sole 2, an insole 3, an upper 4 and two lacing flaps 6,8 with their respective lips 10, 12. Not shown is the tongue of the shoe. It is seen that, in the region of the instep the sole S of the wearer's foot touches the insole 3 of the shoe only along a limited width, the rest of sole S defining with insole 3 a hollow space 14.

Figure 2:
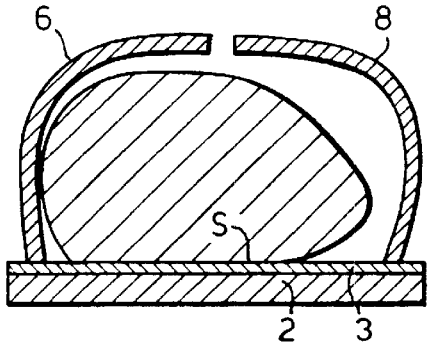
FIG. 2 is a similar view of a foot suffering from a collapsed arch.

FIG. 2 represents the shoe of FIG. 1, but with a foot having a depressed or collapsed arch. As is seen, foot sole S touches insole 3 almost across its entire width.

Figure 3:
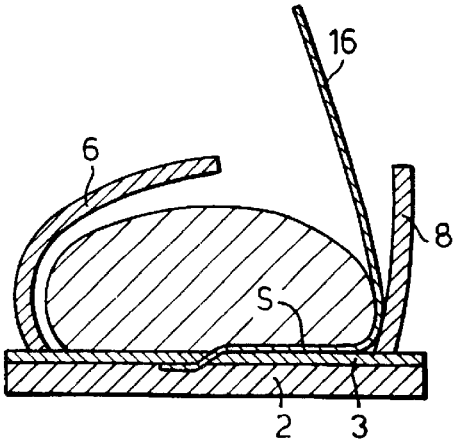
FIGS. 3 and 4 illustrate the working principle of the arch-supporting strap according to the present invention.
Figure 4:
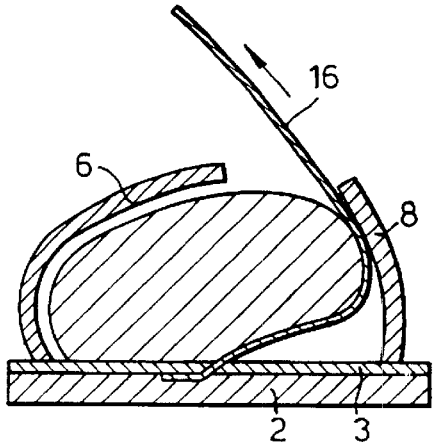

FIGS. 3 and 4 illustrate the principle underlying the arch support according to the present invention. Seen is a strap 16, fixedly attached to the shoe at one of its ends, with sole S fully resting on strap 16 (FIG. 3). When strap 16 is pulled up, as shown in FIG. 4, the wearer's instep is raised until the foot assumes the normal position indicated in FIG. 1. Further below, it will be explained how this position is maintained.

Figure 5:
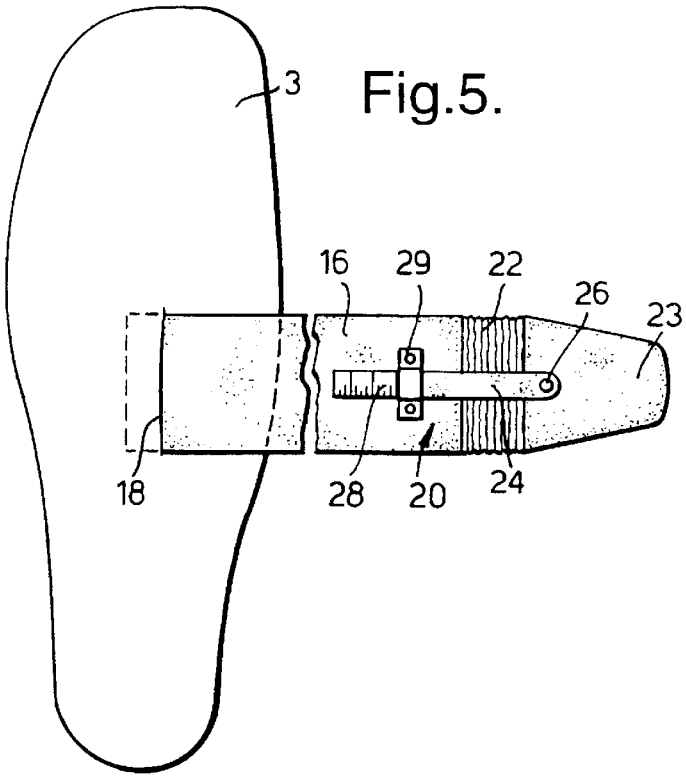
FIG. 5 is a top view of the insole of a shoe according to the invention, including the arch-supporting strap.

FIG. 5 is a top view of the insole of a shoe, including the arch-supporting strap. There are seen insole 3 of a (left) shoe, and strap 16. The latter is advantageously connected to sole 2 (FIG. 1) and insole 3 by being inserted, via a slot 18 in insole 2, between insole 3 and sole 2 and cemented to them, using one of the strong synthetic adhesives. It would also be possible to make strap 16 an integral part of the insole blank.

Further seen in FIG. 5 is a tensiometric device 20, comprising an elastically stretchable portion 22 firmly connecting the end portion 23 of strap 16 to its main portion, a relatively thin and narrow strip 24 fixedly attached to end portion 23 advantageously by means of a rivet 26, and carrying a scale 28. An omega-like member 29, fixedly attached to strap 16, serves as index to this scale, as well as a guide to strip 24. The purpose and operation of this device will be explained further below.

Figure 6:
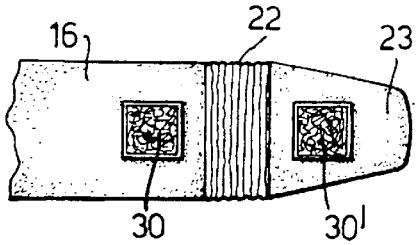
FIG. 6 is a bottom view of the free end of the strap of FIG. 4.

FIG. 6 illustrates the underside of strap 16. Seen are the elastically stretchable portion 22, as well as two patches 30, 30' of Velcro® which, as will be shown further below, are intended to engage a Velcro® counter-patch attached to one of the lacing flaps of the shoe and thereby to lock strap 16 into position.

Figure 7:
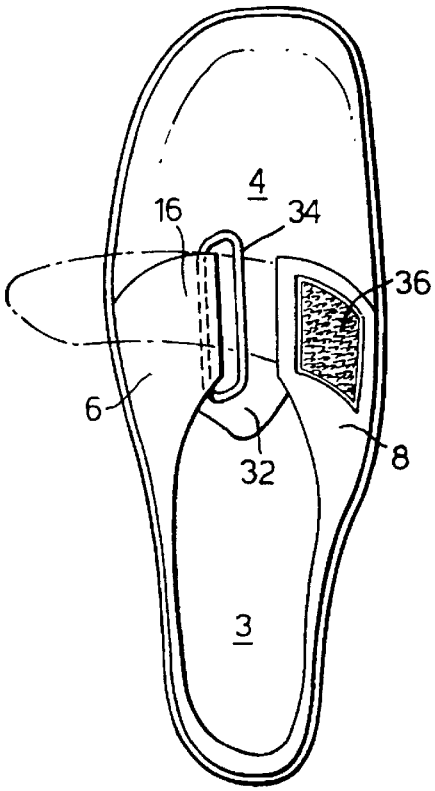
FIG. 7 is a top view of a shoe according to the present invention.

FIG. 7 is a top view of a left shoe according to the invention, showing insole 3, upper 4, left lacing flap 6 and right lacing flap 8, as well as tongue 32. Strap 16 is also seen, indicated by dash-dotted lines. Instead of having the usual round eyelets, flap 6 is provided with an elongated eyelet or buckle 34, through which strap 16 is threaded in preparation for the arch-raising operation. Further seen is the above-mentioned Velcro® counter-patch 36, affixed to lacing flap 8.

Figure 8:
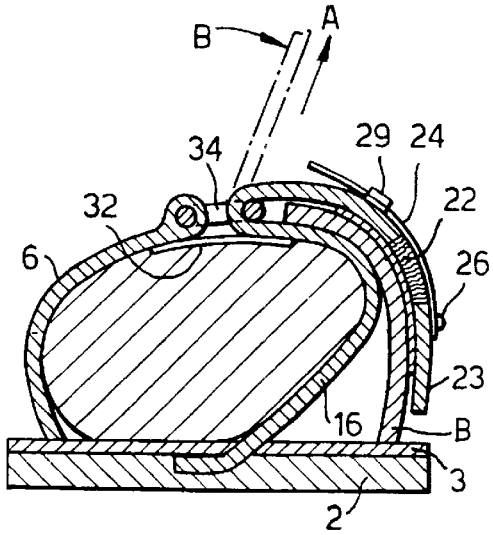
FIG. 8 is a schematic cross-sectional view of a foot inside a shoe according to the invention, with the arch-supporting strap in the locked position.

The following is a description of the way the shoe according to the invention is applied:

After the foot is introduced into the shoe and strap 16 has been threaded through buckle 34 as explained above and as shown in FIG. 7, strap 16 is gripped by its end portion 23 and pulled in the direction of arrow A in FIG. 8 until the arch has been raised to the desired position. After that, strap 16, without reducing the tension, is doubled back upon itself as shown in FIG. 8 (arrow B) and Velcro® patches 30, 30' are attached to, and thus retained by, the Velcro® counter-patch 36 on lacing flap 8 (FIG. 7). Applying a pulling force to strap end portion 23 causes elastic portion 22 to stretch while dragging along strip 24 (see also FIG. 5), due to which scale 28 moves relative to guide member 29. The degree of stretch of elastic portion 22 can thus be read off scale 28 (in arbitrary units) with the aid of guide 29, which, as explained above, acts also as an index line. It is thus possible to reproduce a given indication of tensiometric device 20 (FIG. 5), in other words, the magnitude of arch support provided by strap 16, whenever the shoe is worn.

The term "shoe" as used herein is to be understood as covering all types of footwear.

The terms "right" and "left" are determined by the wearer's viewpoint. In other words, the "right" shoe would be the shoe to be worn on a wearer's right foot, and the right and left sides of that shoe are based on a wearer's viewpoint when the shoe is being worn.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A shoe having a fixed insole and an upper and being provided with an adjustable arch support, comprising:

an arch support strap substantially of a width of a wearer's instep and fixedly attached at one of its ends to, or made integral with, said insole at a point substantially below said instep and in the vicinity of a median line of said insole, said strap extending towards the right in a left shoe and towards the left in a right shoe and having a main portion and a free end portion;

an eyelet provided on a lip of a left lacing flap of said upper in the left shoe and on a lip of a right lacing flap of said upper in the right shoe;

wherein, with a wearer's foot inside the shoe and resting on a first portion of said strap, said strap is passed from below through said eyelet and pulled tight until the wearer's arch has been raised to a desired position, after which said strap is doubled back upon itself and attached to a lateral outside surface of said upper with the aid of an attachment;

characterized in that said strap further comprises a tensioning member constituted by an elastically stretchable portion interposed between a main portion and a free end portion of said strap, said tensioning member being responsive to the tension applied to said strap;

said strap further including an indicator for rendering said tension reproducible.

2. The shoe as claimed in claim 1, wherein said eyelet is an elongated buckle fixedly attached to the lip of the left lacing flap of said upper in the left shoe, and to the lip of the righ lacing flap of said upper in the right shoe.

3. The shoe as claimed in claim 1, wherein said attachment is a hook-and-fastener, part of which is affixed to said strap and part of which is affixed to one of said lacing flaps.

4. The shoe as claimed in claim 1, wherein said indicator comprises a scale, which is fixedly attached to the free end of said strap, and an member fixedly attched to the main portion of said strap.

* * * * *